US005114305A

United States Patent [19]

Akashi et al.

[11] Patent Number: 5,114,305

[45] Date of Patent: May 19, 1992

[54] APPARATUS FOR STORING SLIDE FASTENER SLIDERS

[75] Inventors: Shunji Akashi, Kurobe; Michio Ito, Uozu; Kazuki Kuse, Toyama, all of Japan

[73] Assignee: Yoshida Kogyo K. K., Tokyo, Japan

[21] Appl. No.: 571,717

[22] Filed: Aug. 24, 1990

[30] Foreign Application Priority Data

Aug. 26, 1989 [JP] Japan ..... 1-219748

[51] Int. Cl.[5] ..... B65G 47/26

[52] U.S. Cl. ..... 414/787; 221/68; 198/360; 198/435; 198/436; 198/536

[58] Field of Search ..... 29/766, 768, 408; 414/331, 276, 787, 403, 413, 414; 198/435, 528, 447, 436, 360, 536; 221/68, 106, 123

[56] References Cited

U.S. PATENT DOCUMENTS

| | | | |
|---|---|---|---|
| 1,210,860 | 1/1917 | Sims | 198/360 X |
| 3,018,020 | 1/1962 | Lancaster | 221/68 X |
| 3,526,743 | 9/1970 | Spisak | 221/68 X |
| 3,644,981 | 2/1972 | Gustavssonn | 29/207.5 SL |
| 4,778,063 | 10/1988 | Ueberreiter | 414/403 X |

FOREIGN PATENT DOCUMENTS 1309014 3/1973 United Kingdom .

*Primary Examiner*—Joseph E. Valenza
*Assistant Examiner*—Keith L. Dixon
*Attorney, Agent, or Firm*—Hill, Van Santen, Steadman & Simpson

[57] ABSTRACT

An apparatus is disclosed for storing slide fastener sliders preparatory to application thereof onto a stringer chain, the apparatus comprising a plurality of slider stockers removably mounted on a stocker holder and a slider supply including a chute, the slider stockers being movable successively into operative position registering with the chute to receive therefrom a supply of sliders.

4 Claims, 5 Drawing Sheets

APPARATUS FOR STORING SLIDE FASTENER SLIDERS

BACKGROUND OF THE INVENTION

1. Field of the Invention

This invention relates to an apparatus for storing arrays of sliders preparatory to application onto a fastener stringer chain in the production of slide fasteners.

2. Prior Art

An apparatus of this character is disclosed for example in British Patent 1,309,014 wherein there is provided a store in the form of a rectangular plate having separate tracks for storing rows of sliders of different types or colors, a selected row of sliders being transferred to the position of a slider holder and the desired slider picked up and drawn onto a slide fastener chain. Sliders are mounted and stored on the storing plate by hand or by means of a vibratory feeder while it is attached to a slider feed device because the plate is not removable and in addition, as many vibratory feeders are required as are the number of different types of sliders that are to be stored. This operation is time-consuming and tedious.

SUMMARY OF THE INVENTION

Whereas, the present invention seeks to provide an apparatus for storing a plurality of arrays of sliders for slide fastener in such a manner that there can be maintained a sufficient inventory of sliders of different types and colors automatically without need for separate vibratory feeders and that any selected array of sliders can be readily fed into position for application onto a fastener stringer chain.

The above and other objects of the invention will be better understood from the following detailed description taken in conjunction with the accompanying drawings which illustrate by way of example some preferred embodiments.

According to the invention, there is provided an apparatus for storing arrays of sliders to be applied onto a fastener stringer chain which comprises: a stocker holder having a plurality of a first group of hooks and a second group of hooks; a plurality of slider stockers removably mounted on the hooks and each having a rail; a slider supply means including a chute for lining up and transferring a supply of sliders from the supply means onto the slider stockers; and a drive means for moving the stocker holder relatively to the slider supply means to bring the slider stockers successively into operative position registering with the chute, the first and second groups of hooks being displaced with respect to their common horizontal axis such that each of the slider stockers is tilted downwardly to allow gravity movement of the sliders along the rail.

DETAILED DESCRIPTION OF THE INVENTION

Figure 10:
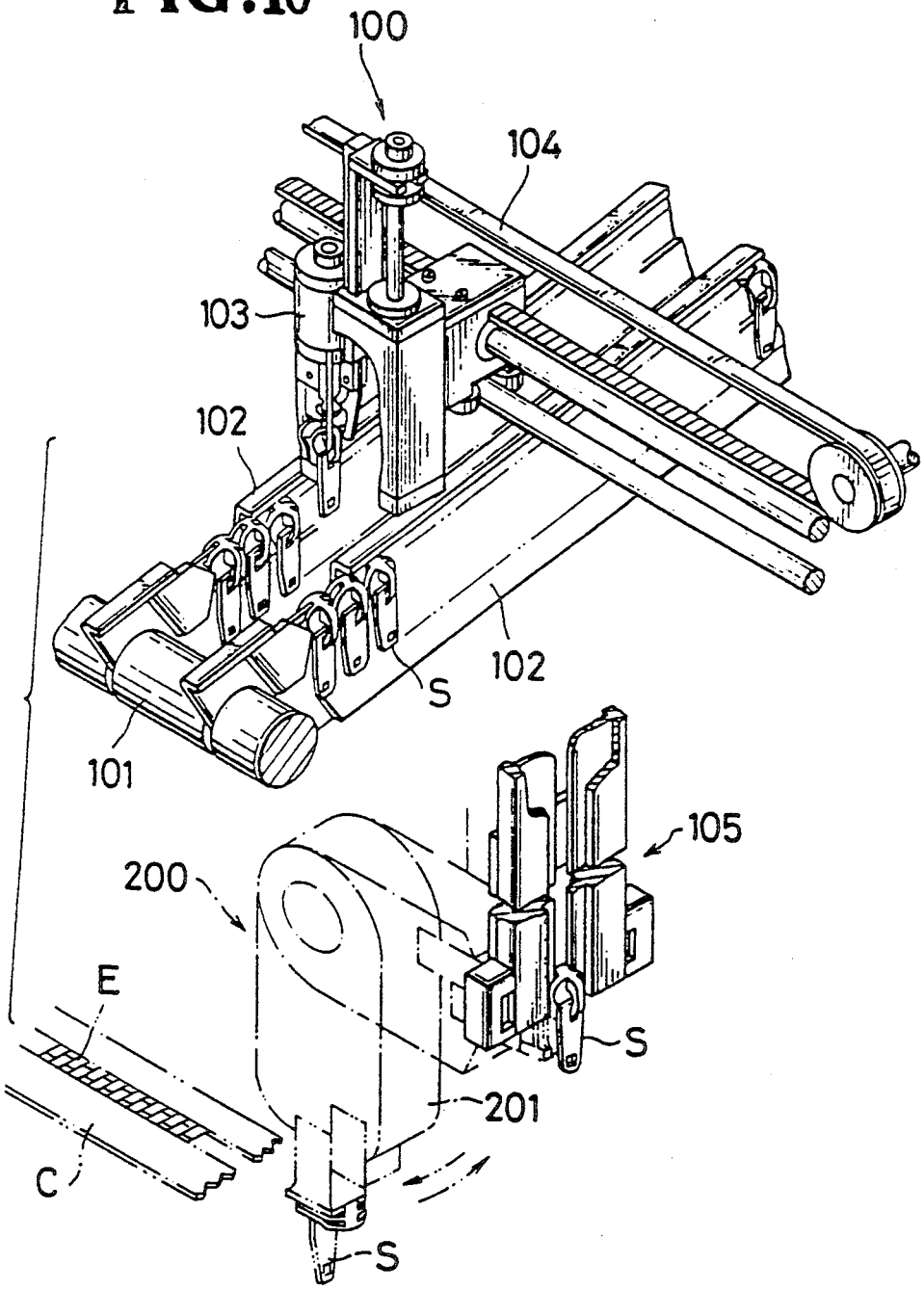
FIG. 10 is a perspective view illustrating a slider feeding unit operatively associated with a slider applying unit.

Referring now to the drawings and firstly to FIG. 10, there is shown a slider feeding unit 100 from which sliders S are fed one at a time to a slider applying unit 200 for application onto a fastener stringer chain C. The apparatus shown in FIG. 10 has already been disclosed in Japanese Patent Application No. 1-193707. The slider feeding unit 100 essentially comprises a pair of oppositely disposed stocker holders 101, only one of which is shown, and a plurality of slider stockers 102 removably secured at opposite ends to the stock holders 101 and each adapted to releasably hold thereon an array of sliders S. A slider transfer holder 103 is reciprocably movable transversely across the arrays of slider stockers 102 by means of a timing drive 104 to pick up a desired one of sliders S for delivery to a slide guide 105, from where the slider S is transferred to the slider applying unit 200 having a slider holder 201 rotatable into and out of the path of the stringer chain C. The slider S is threaded through and mounted over rows of coupling elements E of the stringer chain C in a manner well known in the art.

Figure 1:
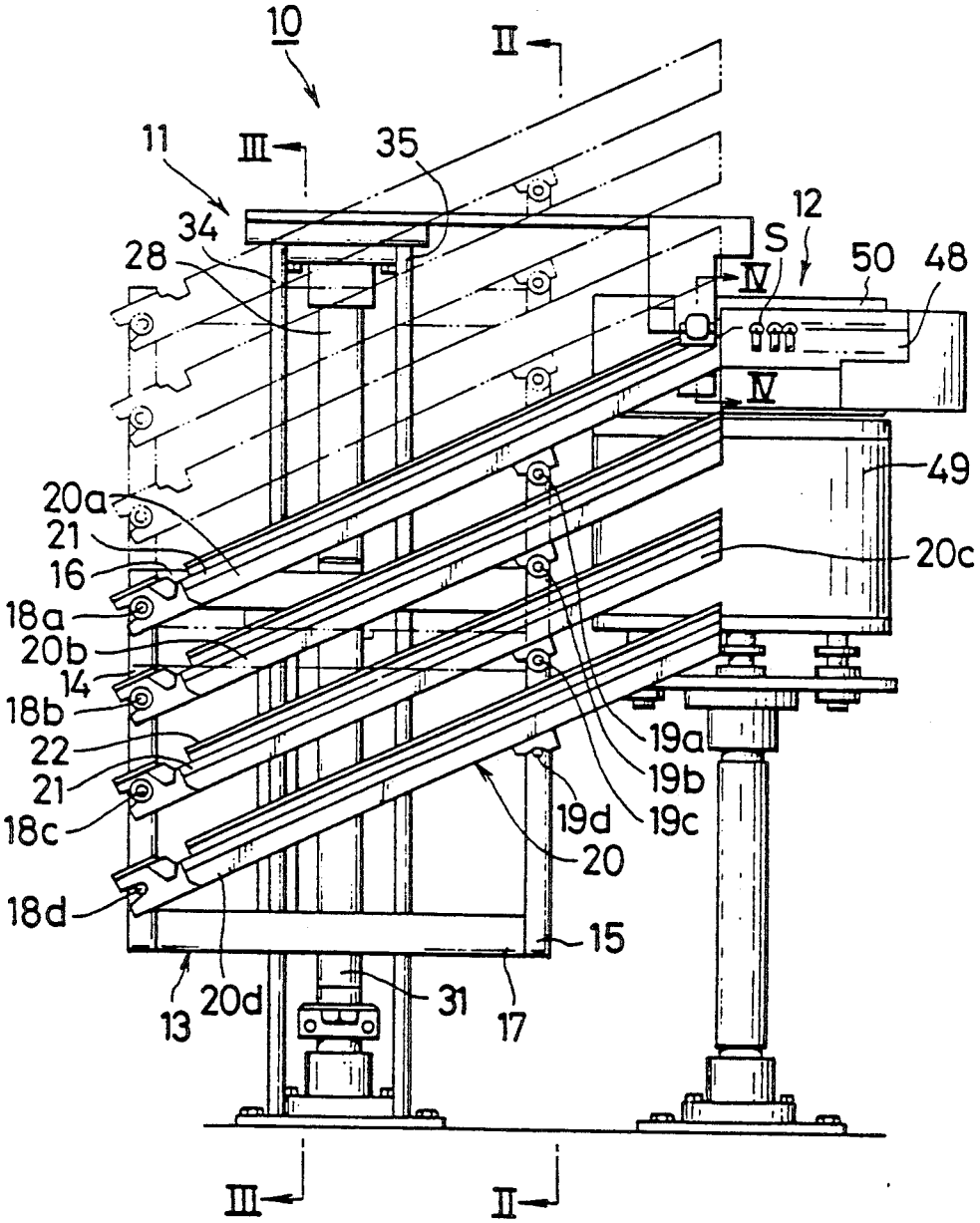
FIG. 1 is a front elevational view of an apparatus constructed in accordance with the invention.

Now, an apparatus generally designated 10 in FIG. 1 embodying the invention is provided to replenish sliders S at the slider feeding unit 100 by exchanging an empty slider stocker with a filled up slider stocker. The apparatus 10 shown in FIG. 1 comprises a slider stocker unit 11 and a slider supply unit 12. The slider stocker unit 11 includes a stocker holder 13 in the form of a rectangular frame having a pair of first and second vertical frame members 14 and 15 and a pair of first and second horizontal frame members 16 and 17 transversely extending between and respectively connected to upper and lower ends of the vertical frame members 14 and 15. A plurality of equally spaced stocker hooks **18*a*–18*d* project horizontally from the first vertical frame member 14 for releasably retaining slider stockers 20*a*–20*d* at one or lower ends thereof. The second vertical frame member 15 has a plurality of similar stocker hooks 19*a*–19*d* for releasably retaining the slider stockers 20*a*–20*d* at upper intermediate positions remote from the lower ends thereof. One group of hooks 18*a*–18*d* and the other corresponding group of hooks 19*a*–19*d* are displaced with respect to their common horizontal axis such that the slider stockers 20*a*–20*d* when mounted in place on the stocker holder 13 are tilted downwardly toward the first vertical frame member 14 as shown in FIG. 1**.

Each of the slider stockers 20 (**20*a*–20*d*) generally in the form of a chute has a rail 21 along which the sliders S slide down by own gravity. More specifically, the slider S has an upper wing $S_1$ and a lower wing $S_2$ defining therebetween a guide channel $S_3$ terminating at a neck $S_4$. The slider S is mounted with its upper and lower wings $S_1$, $S_2$ astride the rail 21 of the slider stocker 20 as better shown in FIGS. 6, 7 and 10. The slider stocker 20 has a longitudinal inverted L-shaped cover 22 overlying the rail 21** and adapted to prevent the sliders S from falling out or derailing.

Figure 5:
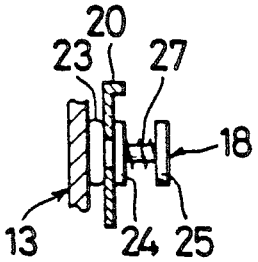
FIG. 5 is a cross-sectional view taken on the line V—V of FIG. 1.

Each of the hooks 18*a*–18*d*, (19*a*–19*d*) has a base portion 23 secured to the stocker holder 13 and a pair of spaced first and second lugs 24 and 25 interconnected by a pin 26 and accommodating therebetween a spring 27 adapted to urge the slider stocker 20 in place between the first lug 24 and the base portion 23 as better shown in FIG. 5.

Figure 2:
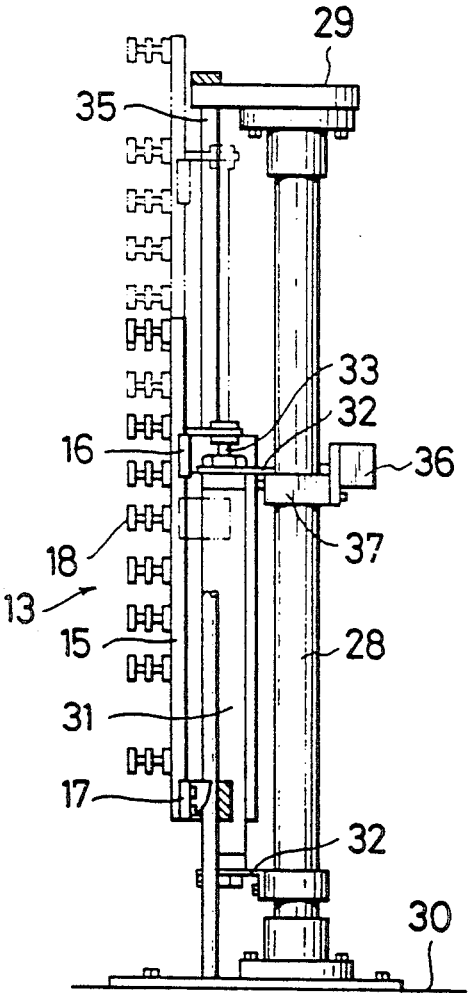
FIG. 2 is a cross-sectional view taken on the line II—II of FIG. 1.

A support post 28 extends vertically between and is reared to upper and lower machine frames 29 and 30. A first pneumatically operated cylinder 31 is vertically disposed and secured by brackets 32 to the support post 28 as shown in FIGS. 1 and 2. A piston rod 33 of the first cylinder 31 has its operating end connected to the upper horizontal frame member 16 of the stocker holder 13 so that its upward stroke causes the stocker holder 13 to move upwardly along a pair of spaced vertical guide rods 34, 35 extending between the upper and lower machine frames 29 and 30 thereby to bring the slider stockers (20*a*–20*d*) successively into operative position registering or interconnecting with a slider chute 48 later described.

A second pneumatic cylinder 36 is secured by a bracket 37 to the support post 28 and has its piston rod 38 connected to a positioning pin 39 extending horizontally from the bracket 37.

Figure 3:
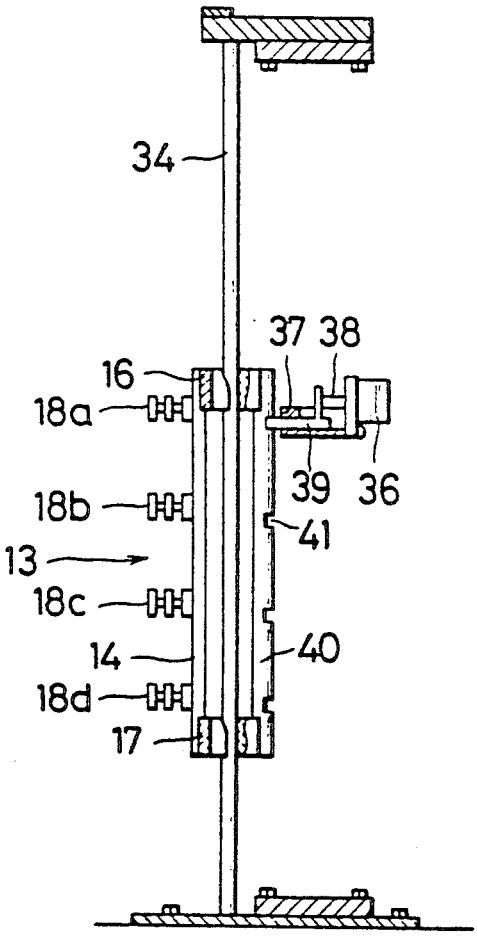
FIG. 3 is a cross-sectional view taken on the line III—III of FIG. 1.

A retainer plate 40 extends vertically between and is secured to the upper (first) and lower (second) frames 16 and 17 of the stocker holder 13. As better shown in FIG. 3, the retainer plate 40 has a plurality of retaining grooves 41 corresponding in position to the hooks 18*a*–18*d* on the first vertical frame 14 of the stocker holder 13. The retaining grooves 41 each are receptive of the positioning pin 39 so that any one of the slider stockers 20*a*–20*d*, when brought into position for receiving sliders S from the slider supply unit 12 as later described, is firmly retained in place against movement.

Figure 4:
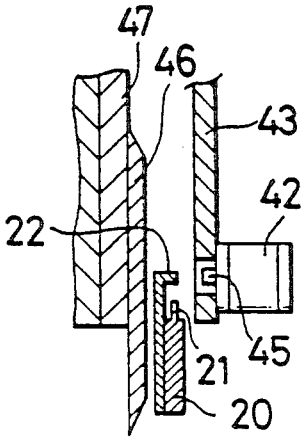
FIG. 4 is a cross-sectional view taken on the line IV—IV of FIG. 1.

A third pneumatic cylinder 42 is secured to a support block 43 located adjacent to an inlet end 44 of the uppermost slider stocker 20*a* held in operative position and has its piston rod 45 horizontally movable toward and away from the cover 22 of the slider stocker 20*a*. A guide plate 46 is secured to a support block 47 and spaced from the support block 43 by a distance to clear the slider stocker 20 as shown in FIG. 4.

Figure 6:
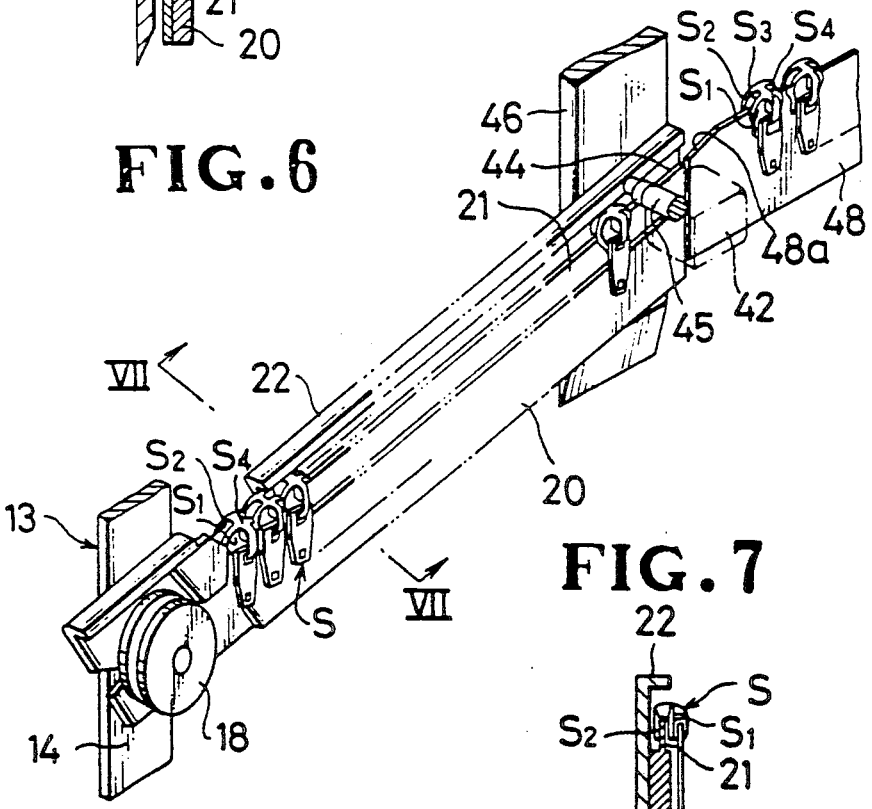
FIG. 6 is a perspective view of a portion of the apparatus shown in FIG. 1.
Figure 7:
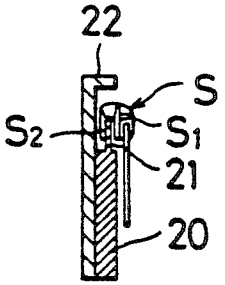
FIG. 7 is a cross-sectional view taken on the line VII—VII of FIG. 6.

With actuation of the third cylinder 42, its piston rod 45 urges the cover 22 of the slider stocker 20 to rest against the guide plate 46 thereby bringing and holding the rail 21 of the slider stocker 20 in alignment with a slider chute 48 (later described) as better shown in FIG. 6.

The slider supply unit 12 comprises a parts feeder 49 of conventional construction with a bowl 50 containing a multiplicity of sliders S of different types or colors and with the slider chute 48 extending from the bowl 50. Sliders S are lined up by vibratory action of the bowl 50 and progressively forwarded along the chute 48 in a manner well known in the art. The chute 48 has a downwardly slanted slide surface 48*a* at its free end as shown in FIG. 6, gravity movement of the slider S being accelerated along the slanted surface 48*a* to facilitate its transfer onto the slider stocker 20.

With the apparatus 10 thus constructed according to the first embodiment of the invention, its operation for the sake of brevity begins with actuation of the first cylinder 31 whereby the uppermost slider stocker 20*a* is brought up into operative position with its inlet end 44 held in confrontation with the free end of the slider chute 48 at the supply unit 12. This is followed by actuation of the second cylinder 36 so that its piston rod 38 is receptively engaged in the retaining groove 41 of the retainer plate 40 thereby to retain the uppermost slider stocker 20*a* stably in place. The third cylinder 42 then operates so as to bring the cover 22 of the slider stocker 20*a* into abutting engagement with the guide plate 46 thereby to hold the rail 21 of the slider stocker 20*a* in alignment with the slanted slide surface 48*a* of the slider chute 48, when the sliders S are allowed to move onto and then progressively along the rail 21 until they fill up the uppermost slider stocker 20*a*. The interrelated operation of the three cylinders 31, 36 and 42 may be conveniently governed by a suitable automatic control means not shown.

Completion of the above slider loading operation is followed by a next predetermined stroke of the first cylinder piston 33 to raise the next empty slider stocker 20*b* into operative position, and the cycle of slider loading or filling operation is repeated. When all of the slider stockers 20*a*–20*d* are loaded, they are delivered to the slider feeding unit 100 for application of the sliders S onto the stringer chain C as shown in FIG. 10.

Figure 8:
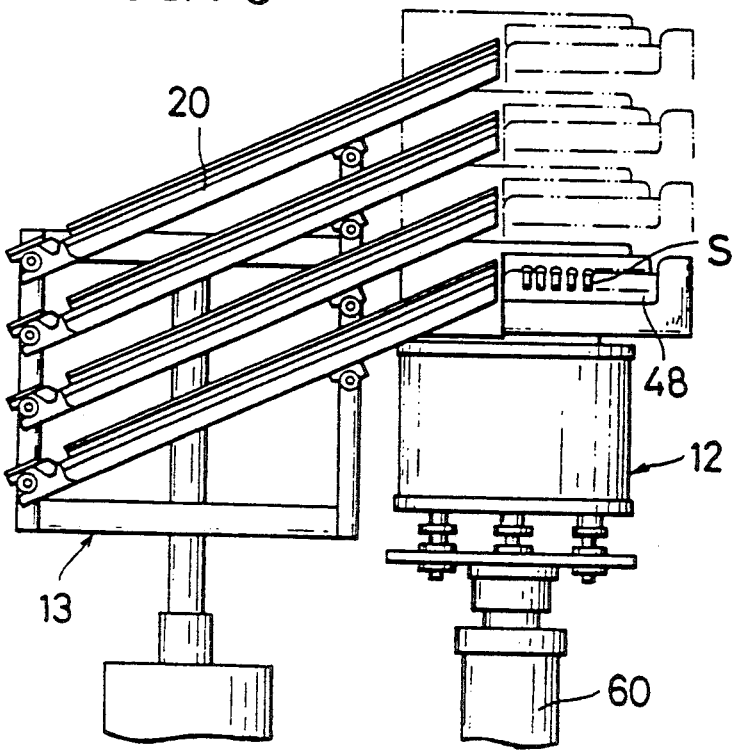
FIG. 8 is a front elevational view of a modified form of apparatus embodying the invention.

FIG. 8 shows a modification of the apparatus 10 in which the slider stocker unit 11 is held stationary while the slider supply unit 12 is made movable relative thereto by means of a pneumatically operated cylinder 60.

Figure 9:
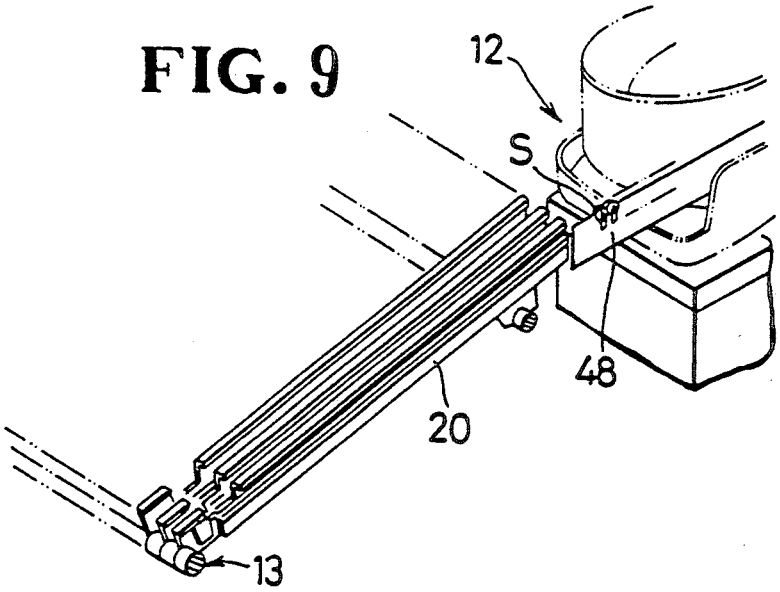
FIG. 9 is a perspective view of another modified form of apparatus embodying the invention.

FIG. 9 shows another modification in which the slider stockers 20 are mounted in horizontal parallel relation to one another and moved horizontally successively into slider filling position with respect to the slider supply unit 12. Alternatively, the slider supply unit 12 may be movable relative to the slider stockers 20.

Obviously, various modifications and variations of the present invention are possible in the light of the above teaching. It is therefore to be understood that within the scope of the appended claims the invention may be practiced otherwise than as specifically described.

What is claimed is:

1. An apparatus for storing arrays of sliders to be applied onto a fastener stringer chain which comprises:

(a) a stocker holder having a plurality of a first group of hooks and a second group of hooks;

(b) a plurality of slider stockers removably mounted on said hooks and each having a rail;

(c) a slider supply means including a chute for lining up and transferring a supply of sliders from said supply means onto said slider stockers; and (d) a drive means for moving said stocker holder relatively to said slider supply means to bring said slider stockers successively into operative position registering with said chute, said first and second groups of hooks being displaced with respect to their common horizontal axis such that each of said slider stockers is tilted downwardly to allow gravity movement of said sliders along said rail.

2. An apparatus according to claim 1 further including a retainer plate secured to said stocker holder and a positioning pin engageable with said retainer plate to retain said stocker holder in position during transfer of sliders from said chute to said slider stocker.

3. An apparatus according to claim 1 further including means of holding said rail of each said slider stocker in alignment with said chute.

4. An apparatus according to claim 1 wherein said slider supply means is movable relatively to said stocker holder.

* * * * *